US006634740B2

(12) United States Patent
Ansell et al.

(10) Patent No.: US 6,634,740 B2
(45) Date of Patent: Oct. 21, 2003

(54) CONSUMABLE MODULE FOR AN ELECTRONIC APPLIANCE

(75) Inventors: Iain Ansell, Newmarket (GB); Anthony Hailes, Royston (GB); Michael John Cox, Royston (GB)

(73) Assignee: Francotyp Postalia AG & Co. KG, Birkenwerder (DE)

( * ) Notice: Subject to any disclaimer, the term of this patent is extended or adjusted under 35 U.S.C. 154(b) by 0 days.

(21) Appl. No.: 10/103,330

(22) Filed: Mar. 21, 2002

(65) Prior Publication Data

US 2002/0135647 A1 Sep. 26, 2002

(30) Foreign Application Priority Data

Mar. 21, 2001 (DE) ..... 101 14 540

(51) Int. Cl.[7] ..... B41J 2/175
(52) U.S. Cl. ..... 347/86; 347/49
(58) Field of Search ..... 347/86, 87, 49, 347/19

(56) References Cited

U.S. PATENT DOCUMENTS

| | | | | |
|---|---|---|---|---|
| 4,813,912 A | | 3/1989 | Chickneas et al. | 705/408 |
| 5,138,344 A | * | 8/1992 | Ujita | 347/86 |
| 5,552,816 A | | 9/1996 | Oda et al. | |
| 5,598,194 A | * | 1/1997 | Hall et al. | 347/50 |
| 5,929,884 A | | 7/1999 | Hetzer et al. | |
| 5,940,103 A | | 8/1999 | Hetzer et al. | |
| 5,969,739 A | | 10/1999 | Altendorf et al. | 347/87 |
| 5,975,688 A | | 11/1999 | Kanaya et al. | 347/86 |
| 6,062,667 A | | 5/2000 | Matsui et al. | 347/19 |

FOREIGN PATENT DOCUMENTS

| | | |
|---|---|---|
| DE | 37 29 342 A1 | 3/1988 |
| DE | 195 40 472 A1 | 5/1996 |
| DE | 196 30 612 A1 | 2/1997 |
| EP | 0 412 459 B1 | 11/1998 |
| EP | 0 875 861 A2 | 11/1999 |

* cited by examiner

*Primary Examiner*—Anh T. N. Vo
(74) *Attorney, Agent, or Firm*—Laurence A. Greenberg; Werner H. Stemer; Ralph E. Locher

(57) ABSTRACT

An electrically operated consumable module to be inserted into a holder of an electronic appliance, in particular an ink cartridge for the printing device of a franking machine, has a consumable device, electrical connecting elements which are connected thereto and which have contact elements to connect the consumable module to a consumable-module controller of the electronic appliance. The consumable module also has a projection to interact with the holder to prevent an insertion into other types of holders. The connecting elements are configured and/or assigned to the projection in such a way that they are at least partly destroyed in the event of an unauthorized removal of the projection.

13 Claims, 4 Drawing Sheets

CONSUMABLE MODULE FOR AN ELECTRONIC APPLIANCE

BACKGROUND OF THE INVENTION

Field of the Invention

The invention relates to an electrically operated consumable module to be inserted into a holder of an electronic appliance. The consumable module has a consumable device, electrical connecting elements which are connected thereto and which have contact elements to connect the consumable module to a consumable-module controller of the electronic appliance, and a projection to interact with the holder to prevent insertion into other types of holders. The invention relates in particular to an ink cartridge for a printing device of a franking machine.

Replaceable ink cartridges for printing devices, such as simple office printers, generally include a consumable device in the form of a print head and an ink reservoir connected thereto. Once the ink cartridge has been inserted into the appropriate holder of the printer, then the print head is connected via the electrical connecting elements to the print controller, which drives the individual printing elements of the print head to print. Such ink cartridges generally have a special geometric configuration, which ensures that the ink cartridge can be inserted only into the holders of those printers for which the ink cartridge is provided. In this case, the abovementioned projections also find their use, in order to ensure that the relevant ink cartridge can be inserted only into a holder configured as a corresponding mating piece.

If this configuration is generally used in conventional office printers to protect the user against the use of incorrect ink cartridges, that is to say those unsuitable for the corresponding printer, there are further problems or requirements in connection with franking machines, which likewise often operate with such ink cartridges.

As a rule, franking machines produce the franking imprint on the letter or item of mail to be dispatched using special ink, which is generally not available on the free market. This ink usually has a specific color and often has fluorescent characteristics or other characteristics. This is used, firstly, for the purpose of making it easier for the mail deliverer to process large quantities of mail quickly by machine through the use of such ink, which increases the detection performance of optical registration systems. A further purpose of the use of such special inks lies in making it more difficult to counterfeit franking imprints by using conventional office printers.

Not least for reasons of reduced manufacturing costs, ink cartridges which in their geometry are the same as the ink cartridges for conventional office printers and are merely filled with the aforementioned special ink have also recently been used for franking machines. However, this solution has the disadvantage that the geometry of the ink cartridge can possibly be changed relatively simply, so that after that the ink cartridge can be inserted into an appropriate office printer.

SUMMARY OF THE INVENTION

It is accordingly an object of the invention to provide a consumable module which overcomes the above-mentioned disadvantages of the heretofore-known consumable modules of this general type and which reliably prevents the use of the consumable module in an appliance not provided for the purpose.

With the foregoing and other objects in view there is provided, in accordance with the invention, an electrically operated consumable module to be inserted into a holder of an electronic appliance, including:

a consumable device;

electrical connecting elements connected to the consumable device;

the electrical connecting elements having contact elements configured to connect the consumable device to a consumable-module controller of the electronic appliance; and a projection configured to interact with the holder and configured to prevent an insertion into an unauthorized holder; and the electrical connecting elements are configured such that at least some of the electrical connecting elements are at least partly destroyed in an event of an unauthorized removal of the projection and/or the electrical connecting elements are assigned to the projection such that at least some of the electrical connecting elements are at least partly destroyed in an event of an unauthorized removal of the projection.

In other words, according to the invention, there is provided an electrically operated consumable module to be inserted into a holder of an electronic appliance, in particular an ink cartridge for the printing device of a franking machine, having a consumable device, electrical connecting elements which are connected thereto and have contact elements to connect the consumable module to a consumable-module controller belonging to the appliance, and a projection to interact with the holder to prevent insertion into other types of holders, wherein the connecting elements are configured and/or assigned to the projection in such a way that they are at least partly destroyed in the event of unauthorized removal of the projection.

The present invention is based on the technical teaching that the use of the consumable module in an appliance not provided for the purpose can reliably be prevented by the connecting elements being configured and/or assigned to the projection in such a way that they are at least partly destroyed in the event of unauthorized removal of the projection. This ensures in a simple way that, in the event of removal of the projection, the feed lines between the consumable-module controller and the consumable device of the consumable module are at least partly cut off, and therefore the satisfactory operation of the consumable module after the removal of the projection is prevented.

For this purpose, the connecting elements can, for example, be mechanically connected appropriately to the projection, so that they are destroyed or damaged as soon as the latter is removed from the consumable module. The shaping and, additionally or alternately, the providing of the connecting elements can in this case be selected such that they are already correspondingly impaired during the attempt to remove the projection. In this case, it is merely necessary to ensure that the loadings which normally act on the projection in normal operation, that is to say during the normal handling of the projection and during insertion into the associated holder, do not lead to any destruction or impairment of the connecting elements.

In the case of particularly simply configured and reliably acting variants of the consumable module according to the invention, provision is made for the connecting elements to run on or in the projection, at least in some sections. This ensures, in a simple way, that the relevant connecting elements are also actually destroyed in the event of removal of the projection.

In order to prevent that the interrupted connecting elements can simply be bridged after the removal of the projection, in preferred developments of the consumable module according to the invention, provision is made for the connecting elements to be provided at least partly in the region of the projection in such a way that, between sections of the connecting elements leading to the projection and away from the projection there is an association or allocation which is transposed with respect to the straight-line association.

This means that a counterfeiter who has a recording of the control signal sequences for the consumable device cannot operate the consumable device of the consumable module with these control signal sequences, since he does not know the association between the individual control signals and the respective sections of the connecting elements which extend from the region of the projection to the consumable device. In the case of a franking machine, as a result of this lack of knowledge, a counterfeiter cannot use a control sequence recorded once for a franking imprint to produce any reproduction of this franking imprint.

In further preferred variants of the consumable module according to the invention, the connecting elements are embedded in at least one conductor foil, and the projection is associated with the conductor foil in such a way that the conductor foil is damaged, with at least partial destruction of the connecting elements, in the event of unauthorized removal of the projection.

For this purpose, the projection can, for example, be configured in such a way that it engages wholly or partly around the conductor foil, including at least one connecting element, so that the conductor foil and therefore the connecting element are damaged, for example torn, in the event of removal of the projection.

In other variants which are preferred, since they can be produced simply, the projection is firmly connected to the conductor foil, at least in some sections. This can be implemented simply, for example by the projection being adhesively bonded or welded to the conductor foil, at least in some sections.

In advantageous developments of the consumable module according to the invention, a storage device for storing consumable-module related information is provided in the projection. This can be, for example, a serial number as well as further identification information with respect to the consumable module and/or to the consumable medium contained in the consumable module. Likewise, use-related information can be stored, for example an item of information that reproduces the quantity of consumable medium already removed.

In the case of an ink cartridge for a franking machine, for example in addition to a serial number of the ink cartridge, the type and an expiry date of the ink can be stored. Likewise, an item of information with regard to the transposed assignment or allocation outlined above of the regions of the connecting elements before and after the projection can be stored. This can then be read out by the controller of the associated franking machine and then taken into account in the drive. This makes it possible to provide the ink cartridges with different assignment transpositions, in order to further reduce the probability of fraud.

The invention may be used in connection with any desired consumable modules in which it is necessary to ensure that they are not used in connection with appliances for which they are not provided. As mentioned, the invention may be used particularly advantageously in connection with franking machines, by configuring the consumable module as an ink cartridge for a franking machine.

In the case of variants of the consumable module according to the invention which are particularly advantageous, since they are highly functionally integrated, the projection has locking devices provided to interact with a locking unit on the holder. For this purpose, for example, it can have a simple ledge or the like, which interacts with a corresponding bolt on the holder.

With the objects of the invention in view there is also provided, in combination with an electronic appliance having a holder with a locking unit, an electrically operated consumable module which includes:

a consumable device;

electrical connecting elements connected to the consumable device;

the electrical connecting elements having contact elements configured to connect the consumable device to a consumable-module controller of the electronic appliance;

a projection configured to interact with the holder and configured to prevent an insertion into an unauthorized holder, the projection having locking devices configured to interact with the locking unit of the holder; and the electrical connecting elements are configured such that at least some of the electrical connecting elements are at least partly destroyed in an event of an unauthorized removal of the projection and/or the electrical connecting elements are assigned to the projection such that at least some of the electrical connecting elements are at least partly destroyed in an event of an unauthorized removal of the projection.

With the objects of the invention in view there is also provided, an electronic appliance, in particular a franking machine, including:

a holder;

an electrically operated consumable module configured to be inserted into the holder, the electrically operated consumable module including a consumable device, electrical connecting elements connected to the consumable device, and a projection;

a controller for controlling the electrically operated consumable module;

the electrical connecting elements having contact elements configured to connect the consumable device to the controller;

the projection being configured to interact with the holder and configured to prevent an insertion into an unauthorized holder; and the electrical connecting elements are configured such that at least some of the electrical connecting elements are at least partly destroyed in an event of an unauthorized removal of the projection and/or the electrical connecting elements are assigned to the projection such that at least some of the electrical connecting elements are at least partly destroyed in an event of an unauthorized removal of the projection.

Other features which are considered as characteristic for the invention are set forth in the appended claims.

Although the invention is illustrated and described herein as embodied in a consumable module for an electronic appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
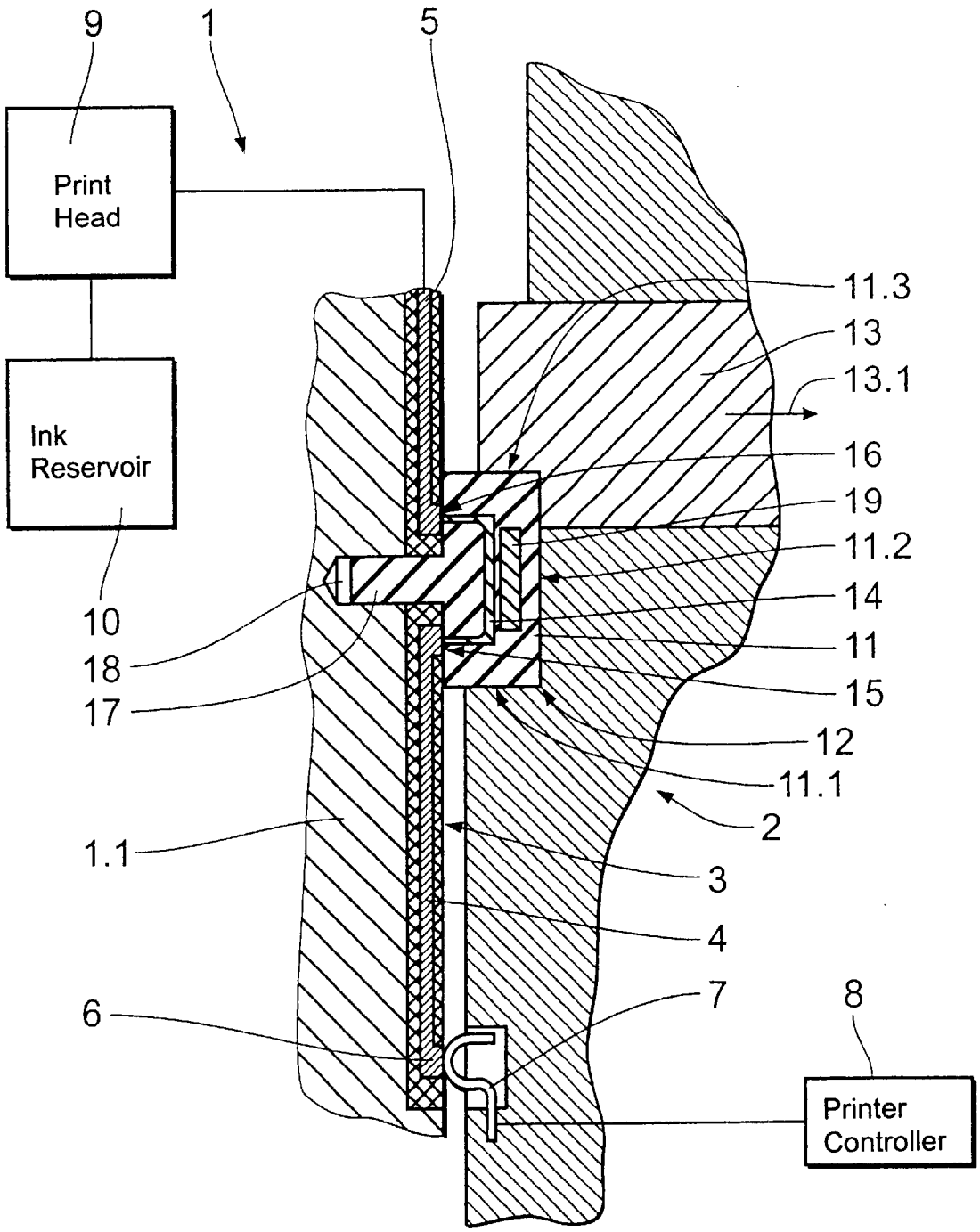
FIG. 1 is a schematic, partial sectional view of a preferred exemplary embodiment of the consumable module according to the invention.

Referring now to the figures of the drawings in detail and first, particularly, to FIG. 1 thereof, there is shown an ink cartridge 1, which is seated in the holder 2 provided for it in a franking machine. The ink cartridge 1 has electrically conductive first and second line sections 4 and 5 embedded in a conductor foil 3 made of electrically insulating plastic. The first line sections 4 are provided at their one end with contact elements 6 which, in the state shown, make conductive contact with sprung contacts 7 which are in turn connected to a printer controller 8 belonging to the franking machine. The second line sections 5 are connected at their one end to a consumable device belonging to the ink cartridge 1, in the form of a print head 9—indicated schematically. This print head is supplied with ink via an ink reservoir 10—likewise indicated only schematically.

Provided on the ink cartridge 1 is a projection in the form of a nose 11, whose end face 11.1 to 11.3 interacts with a ledge 12 and a bolt 13 (movable in a given direction 13.1) on the holder 2, in order to fix the ink cartridge 1 in the holder 2. It goes without saying that, in the case of other variants according to the invention, still further or other devices for fixing the ink cartridge can be provided, which do not interact with the nose.

As mentioned above, for reasons of reduced manufacturing costs, ink cartridges which in their geometry are the same as the ink cartridges for conventional office printers and are merely filled with the aforementioned special ink have also been used for franking machines. In order to prevent insertion into a conventional office printer, provision is made, for example in accordance with U.S. patent application Ser. No. 09/801,544 assigned to the assignee of the instant application, to provide a projection in the form of a nose on the housing of the ink cartridge. However, this solution has the disadvantage that the projection can possibly be removed relatively simply from the housing, so that after that the ink cartridge can be inserted into an appropriate office printer.

In order to prevent this, in the nose 11 there run third line sections 14, which produce an electrically conductive connection between the first line sections 4 and the second line sections 5, by making contact with a first contact region 15 of the first line sections 4 and a second contact region 16 of the second line sections 5. Thus, in the state shown, the connection between the printer controller 8 and the print head 9 is also produced.

The first, second and third line section 4, 5 and 14 together form the electrical connecting elements of the ink cartridge 1. If an attempt is made to remove the nose 11 from the housing 1.1 of the ink cartridge 1, for example by breaking it off or sawing it off, etc., at the same time the third line sections 14 are damaged or the contact between the first line sections 4 and the second line sections 5 is interrupted. By this measure, in other words, the relevant connecting elements are destroyed, and the ink cartridge 1 can thus no longer be operated.

In the example shown, the third line sections 14 and therefore some of the connecting elements run within the nose 11. However, it goes without saying that in the case of other variants, the connecting elements can also run on the outside of the nose. For example, it is possible for the conductor foil to run on the outside of the nose, with connecting elements formed in one piece.

The nose 11 is anchored, by an anchoring device in the form of an anchoring pin 17, in a recess in the form of a hole 18 in the housing 1.1 of the ink cartridge 1. This anchoring bears the majority of the mechanical loadings which are introduced into the ink cartridge via the fixing 12, 13. This ensures that the contact between the first and third line sections 4 and 14 and, respectively, between the second and third line sections 5 and 14 is not impaired in normal operation.

Figure 2:
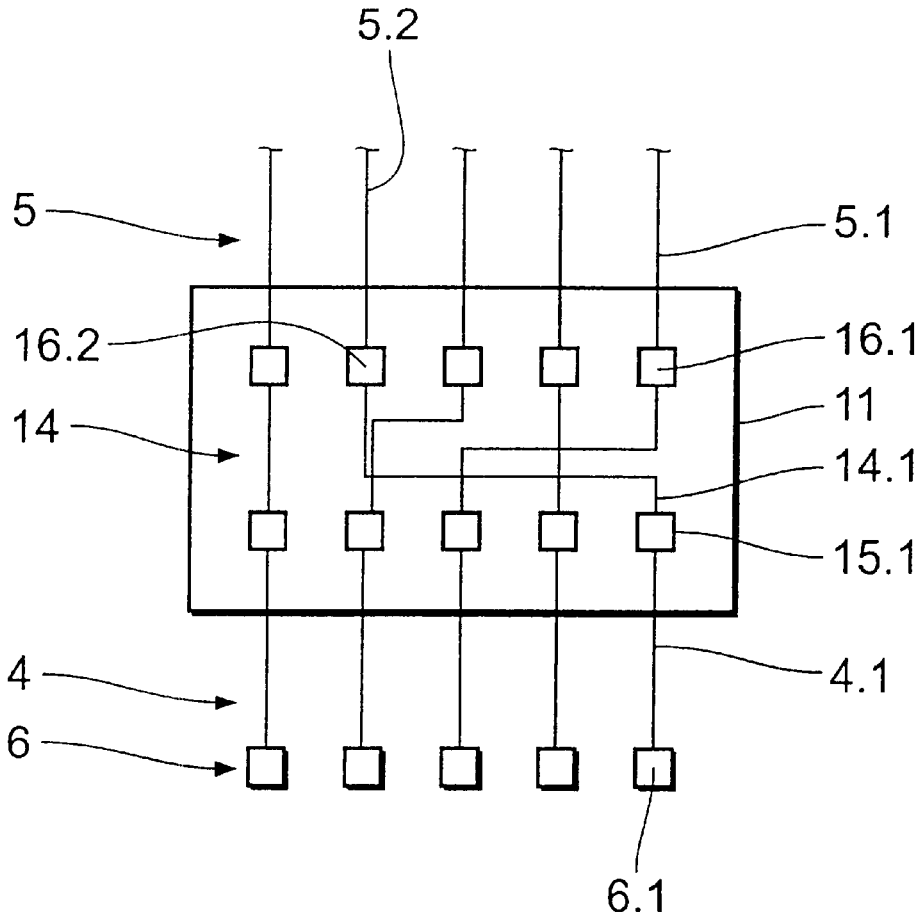
FIG. 2 is a schematic view illustrating the course of the connecting elements in the region of the projection of the variant shown in FIG. 1.

As can be gathered from the schematic representation in FIG. 2, within the nose 11, a transposition of the association between the first line sections 4 and the second line sections 5, differing from the straight-line association, is carried out via the third line sections 14. For example, the first contact region 15.1 of the first line section 4.1, which is connected to contact element 6.1, is not connected to the second contact region 16.1 of the second line section 5.1, as would correspond with the straight-line association, but, via a line section 14.1, to the second contact region 16.2 of the second line section 5.2, provided with an offset thereto.

A counterfeiter, who has a recording of the control signal sequences for the print head 9, tapped off at the contacts 7 and with which a franking imprint could be produced, is not able to operate with these control signal sequences after the removal of the nose 11, by virtue of the outlined transposition of the print head 9 of the ink cartridge 1, since he or she does not know the association between the individual control signals present on the contact elements 6 and the respective second line sections 5 of the connecting elements. Because of this lack of knowledge, a counterfeiter cannot produce any reproduction of this franking imprint with the ink cartridge 1, which he or she has inserted into a conventional printer after removing the nose 11, with a control sequence recorded once for a franking imprint.

It goes without saying, that in the case of other variants, the ink cartridge can be configured in such a way, in particular the nose can be provided in such a way, that even tapping off the control signals at the second line sections is not possible. This can be achieved simply, for example by the nose being provided in a region in which the second line sections are no longer freely accessible at the surface of the ink cartridge.

It goes without saying, furthermore, that the illustration in FIG. 2 is an exemplary, simplified illustration. In particular, this applies with regard to the number of connecting elements. Ink cartridges normally used have a considerably higher number of connecting elements. Depending on the number of connecting elements involved in the transposition, the result is different numbers of possible variations of the transposition. In the case of n connecting elements, the result is n! possibilities for the transposition, so that even with a relatively small number of connecting elements, the result is a sufficiently high number of possible transpositions, in order to provide each ink cartridge of one type with an individual transposition pattern.

As can be gathered from FIG. 1, a storage device in the form of a chip 19 is also embedded in the nose 11, is connected to the printer controller 8 via connections (not illustrated) formed in accordance with the first and second line sections, and can therefore be read out by the printer controller 8 and, additionally or alternatively, data can be written into it. Stored in this chip 19, in addition to a serial number of the ink cartridge 1 and further encrypted information relating to the identification and authentication of the ink cartridge, which are interrogated during or after the insertion of the ink cartridge into the franking machine, are also the type and an expiry date of the ink in the ink reservoir 10. Furthermore, one region of the chip 19 can be written by the printer controller 8 with an item of information with regard to the filling level of the ink reservoir 10. All this information is used in the region of the franking machine in the widest possible sense to ensure satisfactory operation of the franking machine.

Furthermore, the chip 19 contains an item of information with regard to the association outlined above between the first and second line sections 4 and 5, consequently, therefore, an item of information with regard to the association of the regions of the connecting elements before and after the nose 11. This can then be read out by the printer controller 8 and then taken into account in the drive. This makes it possible to provide the ink cartridge 1 with the aforementioned individual association transpositions, in order to further reduce the probability of fraud.

Figure 3:
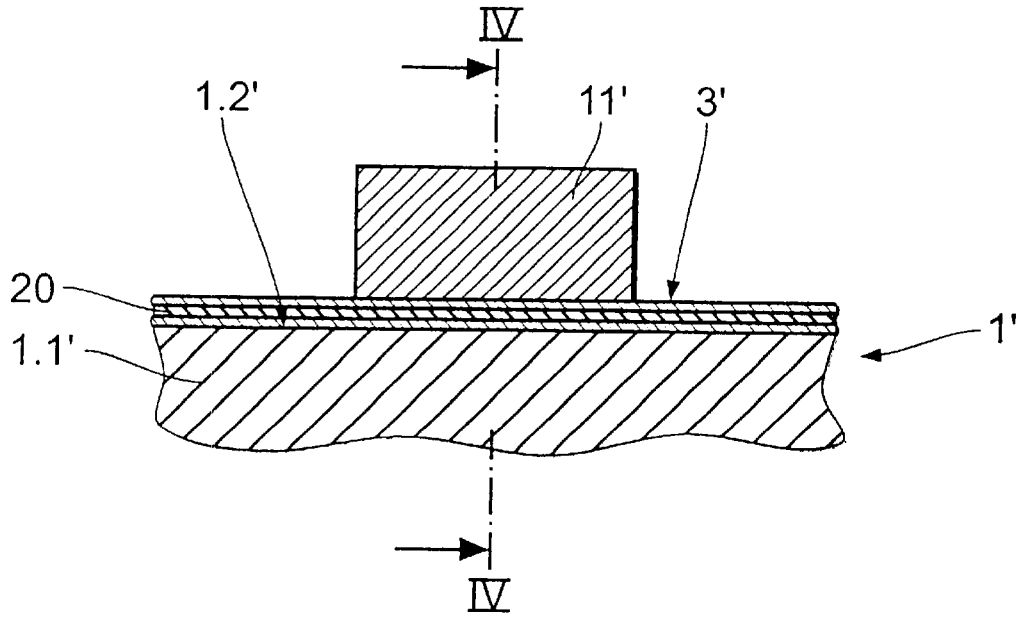
FIG. 3 is a schematic, partial sectional view of a further preferred exemplary embodiment of the consumable module according to the invention.
Figure 4:
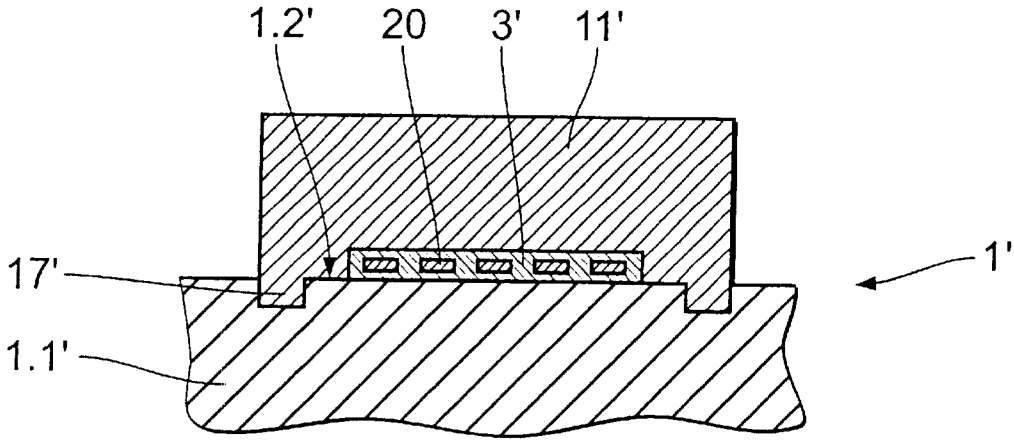
FIG. 4 is a schematic, partial sectional view of the consumable module from FIG. 3 along line IV—IV.

FIGS. 3 and 4 show schematic partial sections through a further preferred embodiment of the consumable module according to the invention in the form of an ink cartridge 1' for a franking machine.

In this variant, the connecting elements 20 formed in one piece are likewise embedded in the conductor foil 3', which is fixed to the surface 1.2' of the housing 1.1' of the ink cartridge 1'. Seated above a subarea of the conductor foil 3' is a nose 11', which ensures that the ink cartridge 1' can be used only in a holder specifically provided for the purpose in an associated franking machine.

The nose 11' is adhesively bonded to the conductor foil 3'. The bond is in this case formed in such a way that its strength is greater than the strength of the conductor foil 3', but at least greater than the strength of the connecting elements 20. The conductor foil 3' therefore remains adhering to the nose 11' when the nose 11' is removed from the ink cartridge 1', and the conductor foil 3' and the connecting elements 20 are then damaged or destroyed when a stress is reached which lies above the relevant strength limit.

In order to increase the probability of occurrence of this effect, the conductor foil 3' is not fixed to the housing 1.1' in the region of the nose 11', so that it lifts off the housing 1.1' without resistance during the removal of the nose 11' from the housing 1.1'. In this case, precisely in the regions of the conductor foil 3' which lie between the regions that are connected to the nose and the housing, particularly high stresses are produced, so that here the above-described damage or destruction occurs quickly.

In the case of other variants, the conductor foil and the connecting elements in the area covered by the nose can also be configured to be weakened appropriately with regard to their mechanical strength, in order to ensure that they are destroyed even in the case of relatively slight lifting or removal of the nose from the housing. Furthermore, it goes without saying that, instead of the adhesive bond described, another type of correspondingly firm connection, for example welding, can be selected.

As can be gathered from FIG. 4, the nose 11' projects laterally beyond the conductor foil 3' and, there, is anchored via anchoring device 17' in corresponding recesses in the housing 1.1'. As already the case in the design from FIG. 1, this anchoring device bears the majority of the mechanical loadings which act on the nose 11' in normal operation. This ensures that the conductor foil 3' and the connecting elements 20 are not impaired in normal operation or during normal handling.

Figure 5:
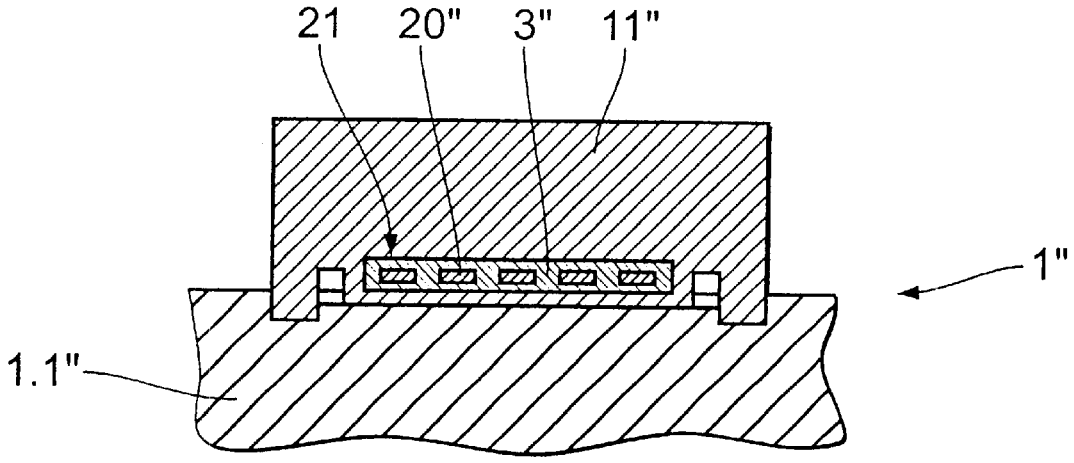
FIG. 5 is a schematic, partial sectional view of another exemplary embodiment of the consumable module according to the invention.

FIG. 5 shows a schematic partial section through a further preferred exemplary embodiment which, in its fundamental construction, equates to that from FIGS. 3 and 4, so that only the differences will be discussed here.

The difference is that the firm connection between the conductor foil 3" and the connecting elements 20" and the nose 11" is not produced by an adhesive bond. Instead, the conductor foil 3" is led through an eyelet-opening 21 in the nose 11".

Here, too, the conductor foil 3" remains connected to the nose 11" during the removal of the nose 11" from the housing 1.1" of the ink cartridge 1", and the conductor foil 3" and the connecting elements 20" are then damaged or destroyed when a stress is reached which lies above their strength limit.

It should be noted at this point that the conductor foils and connecting elements in the appended figures are illustrated only schematically. In particular, for reasons of clarity, they are represented with thickness dimensions which lie far above those which can be used in the actual implementation.

Otherwise, it goes without saying that the individual solutions of the described variants can be combined with one another as desired. In particular, the subdivision outlined in FIG. 1 of the connecting elements into a plurality of line sections can also be applied in the other variants.

Finally, it goes without saying that the connecting elements do not necessarily have to be embedded in the conductor foils described; they can equally well be embedded or provided directly in the housing of the consumable module.

We claim:

1. An electrically operated consumable module to be inserted into a holder of an electronic appliance, comprising:

a housing;

a consumable device;

electrical connecting elements connected to said consumable device, said electrical connecting elements having contact elements configured to connect said consumable device to a consumable-module controller of the electronic appliance; and a projection connected to said housing and configured to interact with the holder and configured to prevent an insertion into an unauthorized holder;

said electrical connecting elements being configured and mechanically connected to said projection such that at least some of said electrical connecting elements are at least partly destroyed in an event of an unauthorized removal of said projection from said housing.

2. The consumable module according to claim 1, wherein at least some of said electrical connecting elements extend at least partially at said projection.

3. The consumable module according to claim 1, wherein at least some of said electrical connecting elements extend at least partially within said projection.

4. The consumable module according to claim 1, wherein:

said electrical connecting elements include sections leading to said projection and sections leading away from said projection; and at least some of said electrical connecting elements are disposed at said projection such that said sections of said electrical connecting elements leading to said projection and said sections of said electrical connecting elements leading away from said projection are assigned to one another with an assignment which is transposed with respect to a straight-line assignment.

5. The consumable module according to claim 1, further comprising:

at least one conductor foil;

said electrical connecting elements being embedded in said at least one conductor foil; and said projection being mechanically connected to said at least one conductor foil such that said at least one conductor foil is damaged and at least some of said electrical connecting elements are at least partly destroyed in an event of an unauthorized removal of said projection from said housing.

6. The consumable module according to claim 5, wherein said projection has given sections, said projection is firmly connected to said at least one conductor foil, at least at said given sections.

7. The consumable module according to claim 5, wherein said projection has given sections, said projection is adhesively bonded to said at least one conductor foil, at least at said given sections.

8. The consumable module according to claim 5, wherein said projection has given sections, said projection is welded to said at least one conductor foil, at least at said given sections.

9. The consumable module according to claim 1, including a storage device disposed in said projection for storing consumable-module related information.

10. The consumable module according to claim 1, wherein said consumable device, said electrical connecting elements, and said projection form an ink cartridge for a franking machine.

11. In combination with an electronic appliance having a holder with a locking unit, an electrically operated consumable module comprising:

a housing;

a consumable device;

electrical connecting elements connected to said consumable device, said electrical connecting elements having contact elements configured to connect said consumable device to a consumable-module controller of the electronic appliance;

a projection connected to said housing and configured to interact with the holder and configured to prevent an insertion into an unauthorized holder, said projection having locking devices configured to interact with the locking unit of the holder; and said electrical connecting elements being configured and mechanically connected to said projection such that at least some of said electrical connecting elements are at least partly destroyed in an event of an unauthorized removal of said projection from said housing.

12. An electronic appliance, comprising:

a holder;

an electrically operated consumable module configured to be inserted into said holder, said electrically operated consumable module including a housing, a consumable device, electrical connecting elements connected to said consumable device, and a projection;

a controller for controlling said electrically operated consumable module;

said electrical connecting elements having contact elements configured to connect said consumable device to said controller;

said projection being connected to said housing and configured to interact with said holder and configured to prevent an insertion into an unauthorized holder; and said electrical connecting elements being configured and mechanically connected to said projection such that at least some of said electrical connecting elements are at least partly destroyed in an event of an unauthorized removal of said projection from said housing.

13. The electronic appliance according to claim 12, wherein said holder, said consumable module, and said controller form a franking machine configuration.

* * * * *